US007650765B2

(12) United States Patent
Rizzetto

(10) Patent No.: US 7,650,765 B2
(45) **Date of Patent: *Jan. 26, 2010**

(54) CLOTHES WASHING MACHINE WITH AN INTEGRATED ARRANGEMENT OF ELECTROMAGNETIC VALVES

(75) Inventor: Pietro Rizzetto, Santo Stino di Livenza (IT)

(73) Assignee: Electrolux Home Products Corporation N.V., Zaventum (BE)

( * ) Notice: Subject to any disclaimer, the term of this patent is extended or adjusted under 35 U.S.C. 154(b) by 146 days.

This patent is subject to a terminal disclaimer.

(21) Appl. No.: 10/557,868

(22) PCT Filed: Apr. 28, 2004

(86) PCT No.: PCT/EP2004/004489

§ 371 (c)(1),
(2), (4) Date: Apr. 2, 2007

(87) PCT Pub. No.: WO2004/106617

PCT Pub. Date: Dec. 9, 2004

(65) Prior Publication Data

US 2007/0220927 A1 Sep. 27, 2007

(30) Foreign Application Priority Data

May 28, 2003 (IT) ..... PN2003A0034

(51) Int. Cl.
*D06F 39/38* (2006.01)

(52) U.S. Cl. ..... 68/17 R

(58) Field of Classification Search ..... 68/17 R, 68/207

See application file for complete search history.

(56) References Cited

U.S. PATENT DOCUMENTS 2,312,950 A 3/1943 Zimarik (Continued)

FOREIGN PATENT DOCUMENTS

EP 0703311 3/1996

(Continued)

OTHER PUBLICATIONS

International Search Report for PCT/EP2004/004489, dated Aug. 17, 2004, 2 pages.

*Primary Examiner*—Frankie L Stinson
*Assistant Examiner*—Samuel A Waldbaum
(74) *Attorney, Agent, or Firm*—Pearne & Gordon LLP

(57) ABSTRACT

Clothes washing machine comprising: a common water-distribution manifold (2), a plurality of electromagnetic (3B, 4B, 5B) valves provided downstream of said water-distribution manifold and connected on a respective inlet side thereof to said common water-distribution manifold, a plurality of outlet conduits (3, 4, 5) provided at the delivery orifices of said electromagnetic valves, a respective plurality of chambers (3A, 4A, 5A) supplied via a respective one of said outlet conduits (6), in which a cold-water inlet conduit (7) directly connects the low-temperature water delivery system to said water-distribution manifold, a hot-water inlet conduit (7) connects the high-temperature water delivery system to a pre-determined one of said outlet conduits downstream of the respective electromagnetic valve, and a further electromagnetic valve (7B) is provided in said hot-water inlet conduit. Inside a pre-determined outlet conduit, and downstream of the respective electromagnetic valve, there is provided a temperature sensor (20).

6 Claims, 5 Drawing Sheets

U.S. PATENT DOCUMENTS

| | | | | | |
|---|---|---|---|---|---|
| 2,956,426 | A | | 10/1960 | Sisson | |
| 3,044,285 | A | * | 7/1962 | Koplin | 68/12.18 |
| 3,086,379 | A | * | 4/1963 | Plante | 68/12.13 |
| 3,747,645 | A | * | 7/1973 | Holster et al. | 137/838 |
| 3,949,576 | A | * | 4/1976 | Waugh et al. | 68/12.18 |
| 4,043,158 | A | * | 8/1977 | Bochan | 68/17 R |
| 4,111,011 | A | * | 9/1978 | Waugh | 68/17 R |
| 4,905,485 | A | * | 3/1990 | Fornasari | 68/12.11 |
| 4,960,139 | A | * | 10/1990 | Rizzetto | 137/625.46 |
| 5,031,427 | A | | 7/1991 | Pastryk et al. | |
| 5,241,843 | A | * | 9/1993 | Hein | 68/3 R |
| 5,884,506 | A | * | 3/1999 | Blauert et al. | 68/17 R |
| 2001/0035221 | A1 | * | 11/2001 | Gurubatham et al. | 137/829 |
| 2001/0049947 | A1 | | 12/2001 | Euler et al. | |

FOREIGN PATENT DOCUMENTS

| | | |
|---|---|---|
| EP | 0725182 | 8/1996 |
| FR | 1387891 | 2/1965 |
| JP | 04237997 | 8/1992 |
| WO | 2002081806 | 10/2002 |

* cited by examiner

CLOTHES WASHING MACHINE WITH AN INTEGRATED ARRANGEMENT OF ELECTROMAGNETIC VALVES

The present invention refers to an improved kind of clothes washing machine, preferably of the type for use in households, which is capable of operating in an improved and more advantageous manner as far as control of the water flows being let into the machine is concerned.

Although reference to a regular, simple-type clothes washing machine will be made throughout the following description, it shall be appreciated that what is set forth below may similarly be applied to and, therefore, be suitable for combined clothes washing and drying machines.

Clothes washing machines are known in the art, which operate by using not only the home water delivery system, which usually delivers cold water, but also an additional water delivery system specially provided in the home to supply hot water. Quite popular in the US market, in particular, is a kind of clothes washing machine for residential use, and even for use in such communities as apartment buildings, boarding schools, colleges and the like, which are not provided with a heating element of their own to autonomously heat up the water flowing in from the public water utility system and used for washing, but are on the contrary arranged to directly take in and use the hot water delivered by said additional hot-water supply system.

These machines are normally provided with an arrangement for taking in water from the outside, and distributing it thereinto, as illustrated symbolically in FIG. 1. This illustration can be noticed to show a first cold-water supply conduit A, a second hot-water supply conduit B, a water distribution manifold C, which said two conduits are adapted to independently and selectively debouch into, i.e. to be fluidly connected therewith in an independent and selective manner through their respective electromagnetic valves E-A and E-B, so that said manifold C is able to be flown through both by both water flows separately and a single flow of mixed hot and cold water flowing in from both said conduits at the same time, depending on the respective electromagnetic valves being opened or closed accordingly.

The average temperature of the water that is in this way delivered into the chambers containing the washing products, such as the washing detergents, the bleaching agent, the fabric conditioner, and the like, will therefore depend not only on the temperatures at which the water flows in from said two conduits in the first place, but also on the mixing percentage or ratio, this mixing percentage or ratio depending in turn quite closely on the actual length of time during which the two electromagnetic valves E-A and E-B are kept open.

Departing from, i.e. branching off said manifold C are three separate and distinct outlet conduits F, G and H, which are connected with said manifold C via respective electromagnetic valves E-F, E-G and E-H that are controllable separately with known means (not shown).

Also known in the art is the practice of providing an appropriate temperature sensor S inside said manifold C, so as to enable the temperature of the water being let thereinto to be measured.

This construction and circuit configuration of the above-described arrangement has turned out as being particularly easy to implement, as well as reliable in its operation. However, it is rather expensive owing to both the presence of as many as five distinct electromagnetic valves, each one of which must be connected independently, and the fact that installing the sensor S inside the manifold C implies a need for two distinct manifold sections to be provided along with pipe unions, sensor support means, as well as positive lock coupling means. All this eventually translates into a rather high overall final cost of the water supply and distribution assembly, which turns out as being by all means undesired in the particular case of a kind of appliance such as a clothes washing machine, which is generally required to be as low and effective in costs as possible in order to prove viable on a very competitive marketplace.

It would therefore be desirable, and it is actually a main object of the present invention, to provide a clothes washing machine adapted to be supplied with both cold and hot water and provided with arrangements that are capable of distributing the individual flows of said hot and cold water to flow into the various chambers containing the washing and rinsing aids according to required sequences and operation modes as generally known as such in the art, wherein the construction costs and complexity of these arrangements are kept at significantly low levels.

According to the present invention, this aim is reached, along with further ones that will be apparent from the following description, in a clothes washing machine incorporating the features as recited in the appended claims.

Anyway, features and advantages of the present invention will be more readily understood from the description that is given below by way of non-limiting example with reference to the accompanying drawings, in which.

Figure 2:
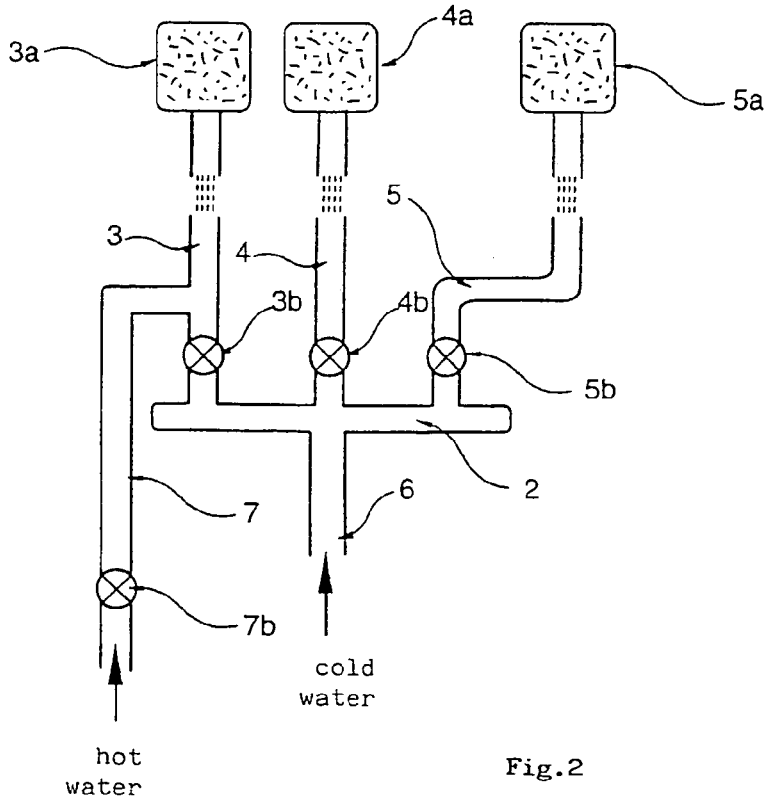
FIG. 2 is a general symbolical, schematic view of a clothes washing machine provided with water supply control means according to the present invention.

With reference to FIG. 2, in a clothes washing machine according to the present invention there is provided a drum 1 adapted to hold the clothes to be washed, a common water distribution manifold 2, a plurality of outlet conduits 3, 4, 5 leading into respective chambers 3*a*, 4*a*, 5*a*, etc., which contain products for use in the washing process and all other processes associated therewith, said outlet conduits comprising a plurality of respective electromagnetic valves 3*b*, 4*b*, 5*b*, and so on, that are adapted to control the flow of water from said common water distribution manifold 2 to each one of said respective outlet conduits 3, 4, 5, etc.

According to a preferred embodiment of the present invention, a cold-water inlet conduit 6 is provided to debouch into said common water distribution manifold 2.

Furthermore, a hot water inlet conduit 7 is provided to connect the hot-water supply system (not shown) to one 3 of said outlet conduits downstream of the respective electromagnetic valve 3*b*.

In said conduit 7 there is furthermore installed a respective electromagnetic valve 7*b*, which is adapted to selectively open and/or close said conduit 7.

All said electromagnetic valves are in turn capable of being actuated into selectively opening and closing by appropriate control means (not shown)

Figure 3:
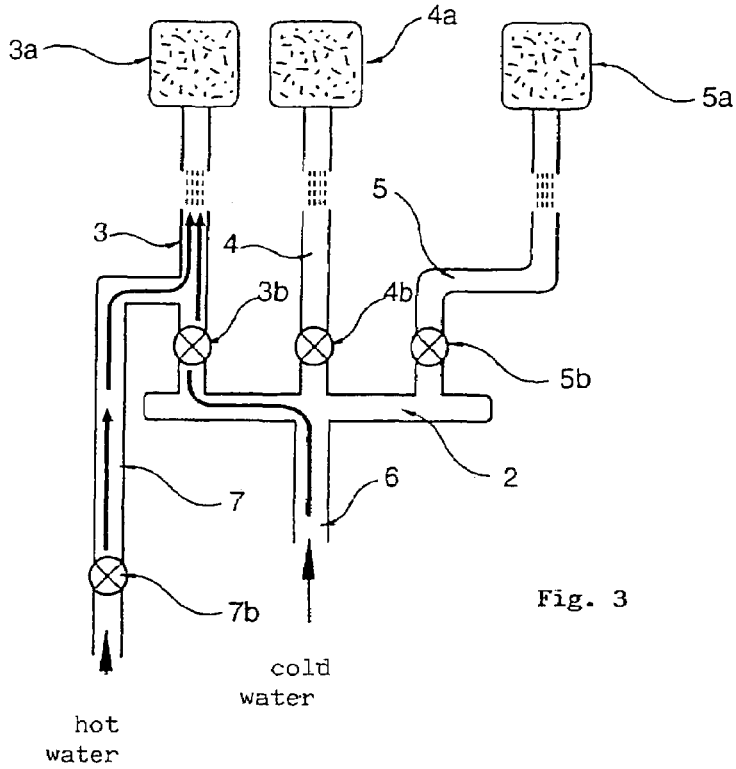
FIG. 3 is a symbolical schematic view of the water circulation and flow pattern in said means according to a first operating mode.

According to a first mode of operation, as best illustrated in FIG. 3, during the main washing phase of the process, i.e. when the need arises for a certain amount of water heated up to a pre-set temperature to be let into the machine, use is made of the outlet conduit 3, and the chamber 3*a* (as appropriately filled with washing product) associated therewith, which can actually be supplied with both hot and cold water. To this purpose, the two electromagnetic valves 7*b* and 3*b* are actuated into opening, and kept open, either in a sequence or, alternatively, even at the same time, anyway in such a manner as to ensure that the temperature of the mixed cold and hot water flowing in from the two water supply conduits 6 and 7, respectively, reaches up to a pre-set value at the end of the water filling phase of the process.

Figure 4:
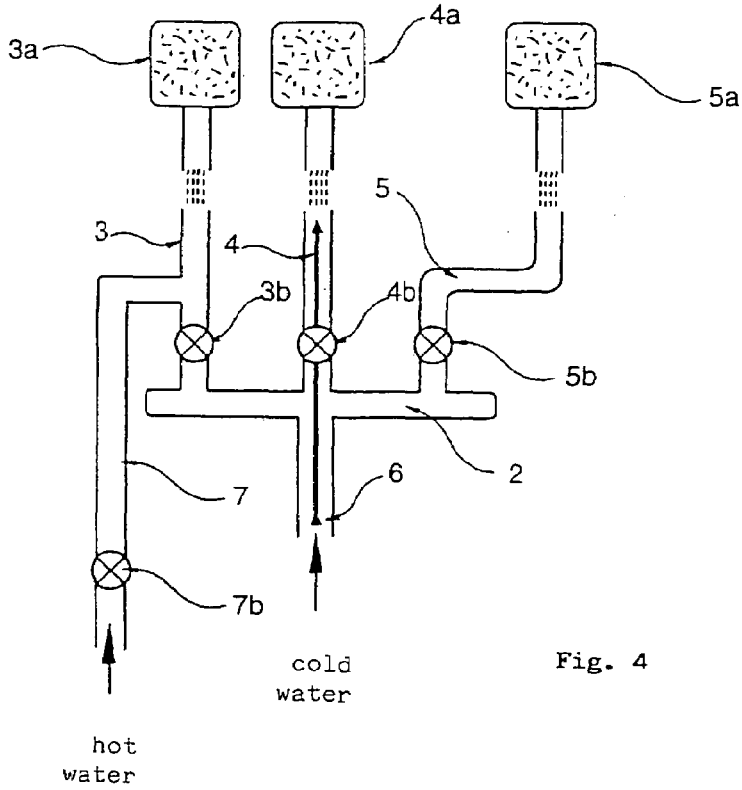
FIG. 4 is a symbolical schematic view of the water circulation and flow pattern in said means according to a second operating mode.

According to a second mode of operation, as best illustrated in FIG. 4, when a certain amount of cold water mixed with a definite substance is for instance to be let into the clothes holding drum, said definite substance is filled into the chamber 4*a*, while only enabling the respective electromagnetic valve 4*b* to be opened for a length of time as required to fill a desired amount of water into the drum.

A similar procedure is followed when a third substance is to be introduced in the drum, in which said substance would in this case be filled in the chamber 5*a*.

Those skilled in the art will of course be readily capable of determining the required sequence of the opening and closing cycles of the various electromagnetic valves on the basis of the actual sequence and progression of the washing programme, as well as the use which the various chambers are intended for.

It is therefore readily apparent that the present invention is capable of reaching its main aim, which practically lies in the possibility for the use of an electromagnetic valve to be dispensed with. If the water circuit shown in FIG. 2 is in fact compared with the water circuit that is on the contrary illustrated in FIG. 1, it readily appears that both circuits are capable of ensuring the same function, but, while as many as five electromagnetic valves are used in the arrangement of FIG. 1, only four such electromagnetic valves are used in the arrangement illustrated in the FIGS. 2 to 4, where an electromagnetic valve is therefore spared.

Figure 1:
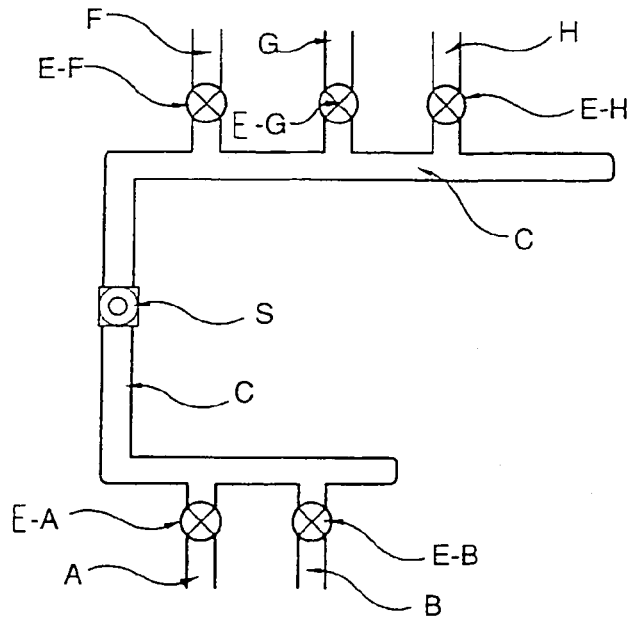
FIG. 1 is a general symbolical, schematic view of a clothes washing machine provided with water supply control means according to the prior art.

To be precise, the actual function is not fully identical in the two above-mentioned water circuits, since each one of the conduits A, B and C can be supplied with both hot water and cold water in a independent, selective manner in the circuit according to the arrangement shown in FIG. 1, whereas the outlet conduits 4 and 5 cannot be supplied also with hot water in the circuit according to the arrangement shown in FIG. 2. However, since only the conduit 3 must be capable of being supplied with both cold and hot water in the circuit according to the arrangement shown in FIG. 2, while the remaining conduits 4 and 5 must on the contrary never be supplied with hot water, it ensues that the above-noted functional difference—as far as the application in clothes washing machine is concerned—is just a theoretical one. It may therefore be concluded that the two above-mentioned circuits, as used in a clothes washing machine, operate in a fully equivalent manner.

The above-described invention allows for some advantageous improvements to be implemented. A first such improvement is based on the fact that in a clothes washing machine the need may arise for not only three, but even four chambers to be provided for receiving the washing products, rinsing aids and similar substances (i.e. pre-wash detergent, main wash detergent, bleaching agent, fabric conditioner) to be flushed into the drum.

In all these cases, it is therefore necessary for as many as four distinct chambers to be provided, each one of which will then be filled with a specific substance and flushed by an appropriate flow of water at pre-determined moments and for pre-determined lengths of time during the washing programme, depending on the process step being carried out.

The above-noted improvement lies in the fact that a clothes washing machine, further to the usual three distinct chambers 3*a*, 4*a*, 5*a*, is provided with an additional chamber 34, which, however, according to this improvement of the invention is supplied with water without this requiring any specific electromagnetic valve and water delivery conduit to be specially provided to this purpose.

Figure 5:
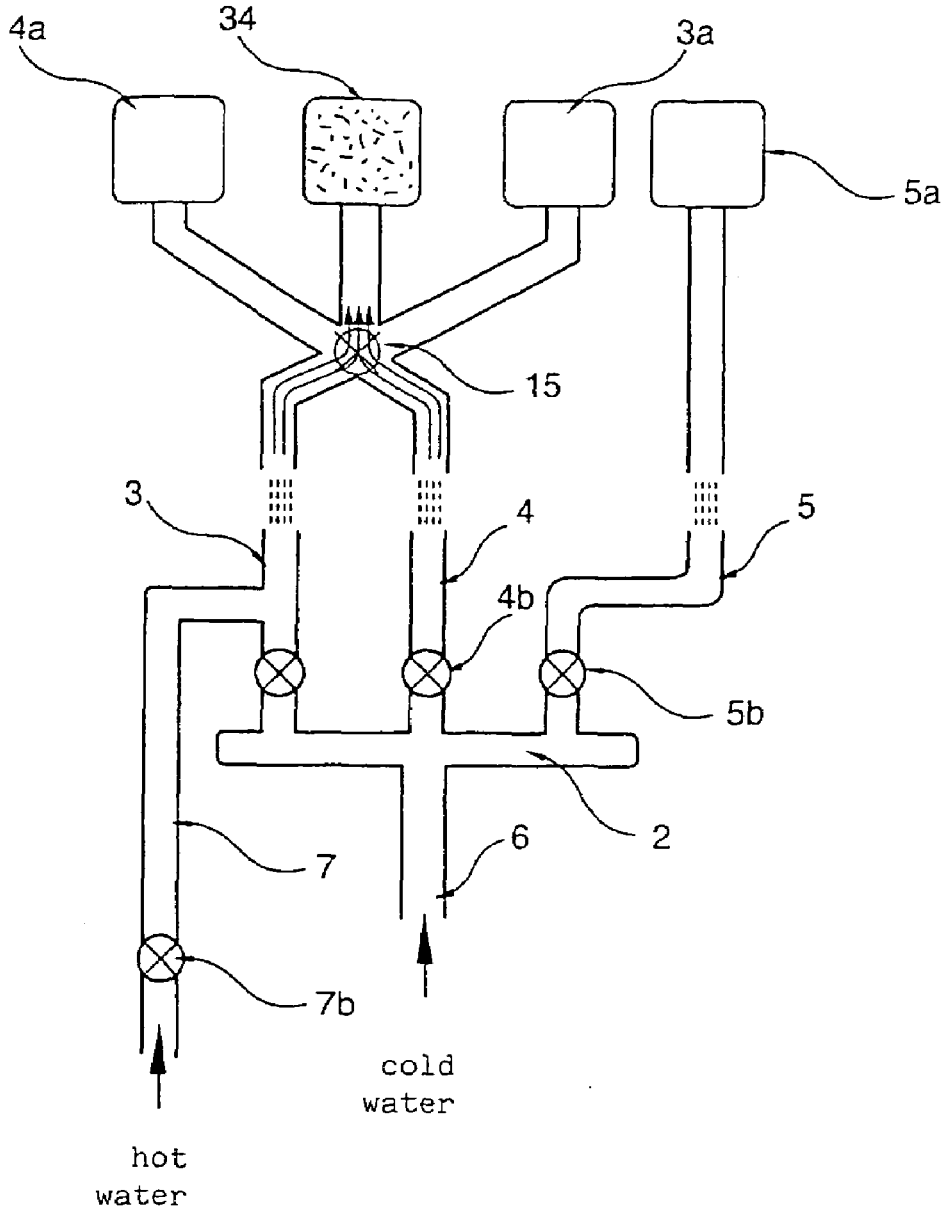
FIG. 5 is a symbolical schematic view of the water circulation and flow pattern in said means according to a third operating mode, in a modified and improved clothes washing machine.

In fact, with reference to FIG. 5, it can be noticed that the conduits 3 and 4 regularly include a so-called air gap and are so shaped and arranged as to enable said respective air gaps to intersect each other, while said additional chamber 34 is situated below the common intersection zone 15 of said air gaps.

Then, if the related water delivery conduits are activated at the same time, the resulting flows of water passing therethrough will impinge against each other at said common intersection zone 15 of the air gaps, thereby giving rise to a combined flow that falls by gravity—as desired—into said additional chamber 34.

Such approach to bringing about an additional flow of water following selectively controlled flows of water crossing each other and impinging against each other is already known as such in the art. However, the above-described improvement does not refer to the mere and plain application of such approach to a clothes washing machine according to the present invention, actually, but is rather aimed at improving the invention itself through an advantageous transfer of the prior-art technique, thereby ultimately enabling as many as four distinct washing-product chambers, one of which being even capable of being supplied with both cold water and hot water, to be supplied with water and flushed independently by using just four electromagnetic valves on the whole.

Figure 6:
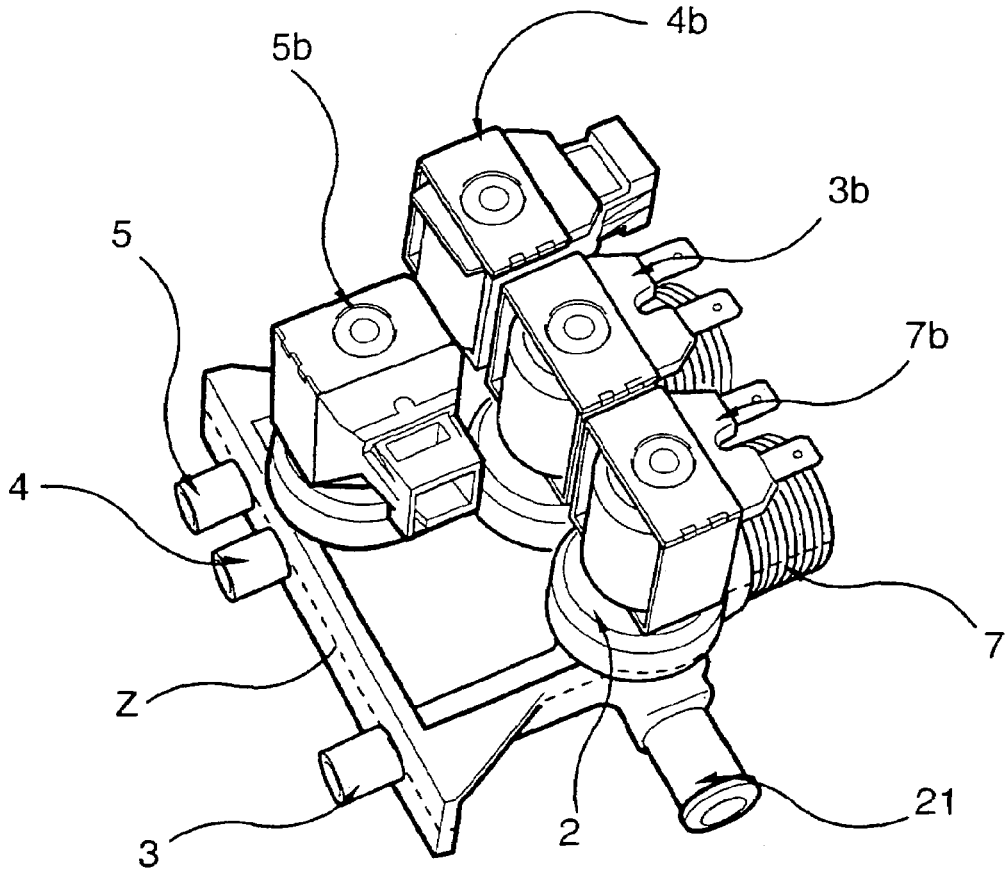
FIG. 6 is a perspective view of a preferred embodiment of the water supply control means according to the present invention.
Figure 7:
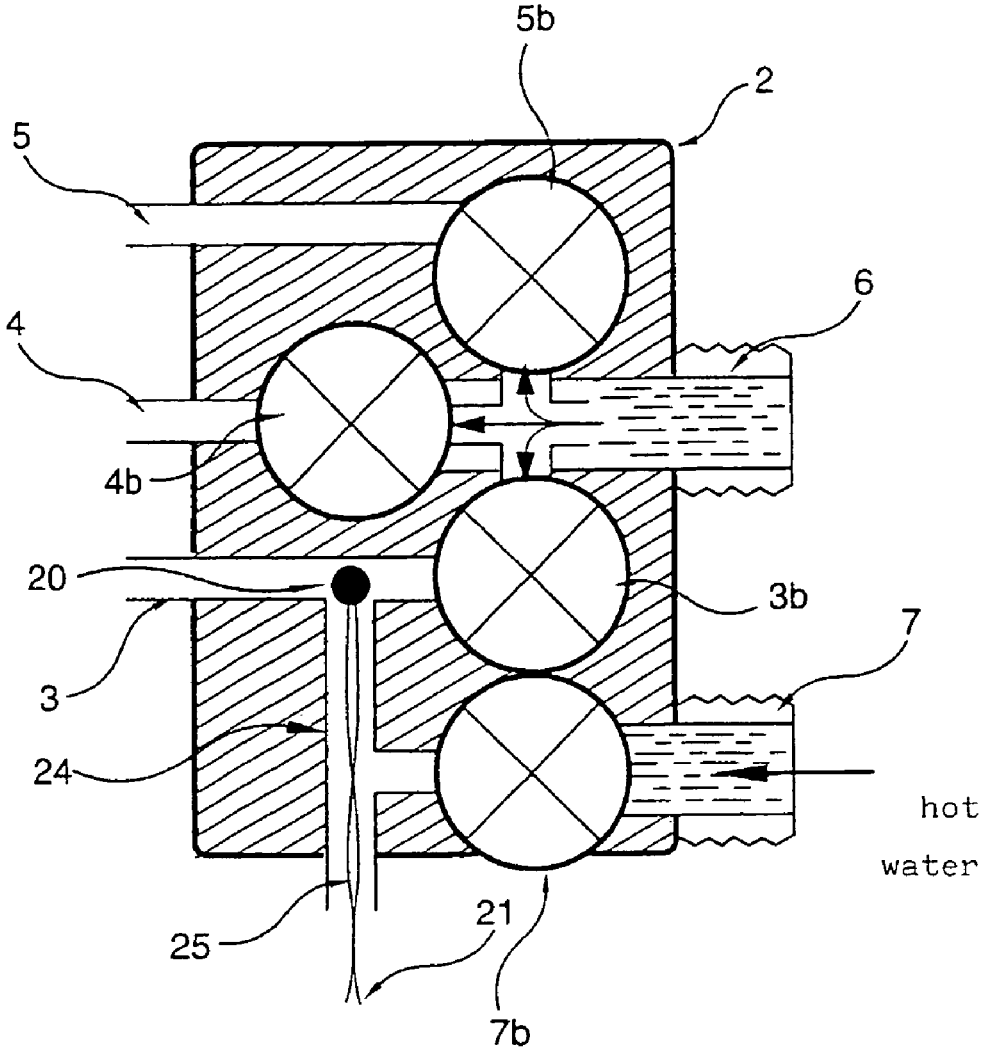
FIG. 7 is a planar sectional view of the water supply control means illustrated in FIG. 6, as taken along the sectional plane Z in the same FIG. 6.

A second improvement refers to the physical configuration of the devices used in the arrangement according to the present invention. In fact, if reference is made to FIGS. 6 and 7, it can be noticed that the possibility exists for space to be spared to a quite considerable extent and the manufacturing process to be simplified in an equally considerable manner, thereby cutting all associated costs and burdens accordingly, if said common distribution manifold 2 and the two cold-water and hot-water inlet conduits 6 and 7, respectively, are integrated with each other to a maximum possible extent, preferably by making all these parts at least partially in the form of a single-piece construction. In addition, said four electromagnetic valves 3*b*, 4*b*, 5*b*, 7*b* are mounted in a mutually juxtaposed arrangement and, in particular, possibly aligned with each other, so as shown in FIG. 6, in view of further reducing space requirements, so that said distribution channel or manifold 2 is practically brought down to a small elongated chamber arranged in correspondence to the outlet ports of the electromagnetic valves, so as illustrated schematically in FIG. 7, where it can be noticed that the three electromagnetic valves 3*b*, 4*b*, 5*b* are arranged in a substantially fan-like manner around the outlet port of the cold-water inlet conduit 6.

A third improvement relates to the temperature sensor 20. Referring again to FIG. 7, an appropriate pipe extension 21 in an elongated and rectilinear form is associated to said common water-distribution manifold 2, so that the possibility is given for the interior of said manifold 2 to be acceded to, and in particular at a point situated immediately downstream of the electromagnetic valve 3*b*, from the outside through such extension. By using said pipe extension it is therefore possible for said temperature sensor 20 to be inserted in the manifold 2 and then pushed into and positioned inside the outlet conduit 3, immediately downstream of the related electromagnetic valve 3*b*. In this way, said sensor is able to come into contact with the flow of hot and cold water immediately upon said hot and cold water having mixed together downstream of the electromagnetic valve 3*b*, while the related connection leads 25 are able to accompany the sensor by stretching out through said extension and the manifold section located between the electromagnetic valves 3*b* and 7*b*, and then passing through the outward-leading aperture 24 of said extension 21 to exit therefrom.

This sensor can be easily shifted and kept in position with the aid of appropriate support means (not shown), so as to enable it to possibly be most conveniently replaced by simply opening said aperture 24, pulling out the sensor and the related connections, inserting a new sensor and, finally, plugging up again the tubular extension 21.

The clothes washing machine shall finally be provided with appropriate control means (neither shown nor described here, owing to them being largely known as such in the art), which will enable said four electromagnetic valves to be actuated into opening and closing independently according to a predefined sequence in due synchronism with the other functions being performed by the machine in accordance with the washing programme selected.

The invention claimed is:

1. Clothes washing machine comprising:

a drum (1) for holding the clothes to be washed, a common water-distribution manifold (2), a plurality of electromagnetic valves (3b, 4b, 5b, . . . ) arranged downstream of said water-distribution manifold and connected on a respective inlet side thereof to said common water-distribution manifold (2), a plurality of outlet conduits (3, 4, 5, . . . ) provided at the delivery ports of respective ones of said electromagnetic valves, a respective plurality of chambers (3a, 4a, 5a) provided to contain washing products, rinsing aids and similar substances, each one of said chambers being supplied via a respective one of said outlet conduits (3, 4, 5), characterized in that:

a cold-water inlet conduit (6) directly connects the low-temperature water supply system to said water-distribution manifold (2), a hot-water inlet conduit (7) connects the high-temperature water supply system to a pre-determined one (3) of said outlet conduits downstream of the respective electromagnetic valve (3b), a further electromagnetic valve (7b) is installed in said hot-water inlet conduit (7) upstream of the point at which the latter connects with said pre-determined outlet conduit (3).

2. Clothes washing machine according to claim 1, characterized in that said outlet conduits are provided in the number of three (3, 4, 5), in that there is provided a fourth chamber (34), in that said fourth chamber is supplied with and flushed by a respective flow of water that is brought about by two flows of water generated by two respective ones (3, 4) of said outlet conduits crossing each other and impinging with each other at the intersection point thereof.

3. Clothes washing machine according to claim 1 or 2, characterized in that said common water-distribution manifold, said cold-water inlet conduit (6) and said hot-water inlet conduit (7) are made integrally with each other, and in that said four electromagnetic valves (3b, 4b, 5b, 7b) are provided in an arrangement in which they are substantially aligned with each other.

4. Clothes washing machine according to claim 1, characterized in that each one of said electromagnetic valves (3b, 4b, 5b, 7b) is controllable selectively.

5. Clothes washing machine according to claim 1, characterized in that inside said pre-determined outlet conduit (3), and downstream of a respective electromagnetic valve (3b), there is provided a temperature sensor (20).

6. Clothes washing machine according to claim 5, characterized in that to said common water-distribution manifold (2) there is associated a tubular extension (21), having a preferably elongated shape and provided with an outward-leading aperture (24), which is adapted to allow for said temperature sensor (20) to be inserted in and mounted inside said common water-distribution manifold (2), in particular downstream of said pre-defined electromagnetic valve (3b).

* * * * *